US009275815B2

(12) United States Patent
Hoffmann et al.

(10) Patent No.: US 9,275,815 B2
(45) Date of Patent: Mar. 1, 2016

(54) RELAY HAVING TWO SWITCHES THAT CAN BE ACTUATED IN OPPOSITE DIRECTIONS

(71) Applicant: Phoenix Contact GmbH & Co. KG, Blomberg (DE)

(72) Inventors: Ralf Hoffmann, Berlin (DE); Jens Heinrich, Falkensee (DE); Christian Mueller, Berlin (DE); Olaf Abel, Werder (DE); Thomas Kuehne, Berlin (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 14/388,110

(22) PCT Filed: Mar. 27, 2013

(86) PCT No.: PCT/EP2013/056570

§ 371 (c)(1),
(2) Date: Sep. 25, 2014

(87) PCT Pub. No.: WO2013/144232

PCT Pub. Date: Oct. 3, 2013

(65) Prior Publication Data

US 2015/0042423 A1 Feb. 12, 2015

(30) Foreign Application Priority Data

Mar. 30, 2012 (DE) ..... 10 2012 006 438

(51) Int. Cl.
*H01H 50/54* (2006.01)
*H01H 50/02* (2006.01)
(Continued)

(52) U.S. Cl.
CPC ..... *H01H 50/54* (2013.01); *H01H 50/02* (2013.01); *H01H 50/14* (2013.01); *H01H 50/18* (2013.01);
(Continued)

(58) Field of Classification Search
CPC . H01H 50/041; H01H 49/00; H01H 51/2236; H01H 51/22; H01H 45/00; H01H 45/02; H01H 45/04; H01H 45/06; H01H 45/08; H01H 51/01; H01H 50/541; H01H 50/02; H01H 50/14; H01H 50/18; H01H 50/54; H01H 50/642; H01H 51/2272; H01H 51/2281; H01H 51/229; H01F 7/122
See application file for complete search history.

(56) References Cited

U.S. PATENT DOCUMENTS 4,286,244 A * 8/1981 Schuessler ..... H01H 51/2281 335/230
4,703,293 A 10/1987 Ono et al.
(Continued)

FOREIGN PATENT DOCUMENTS

DE GB 1187884 A * 4/1970 ..... H01H 51/2272
DE 2148177 A1 3/1972
(Continued)

OTHER PUBLICATIONS

"Related International Application No. PCT/EP2013/056570", "International Preliminary Report on Patentability", Oct. 9, 2014, Publisher: International Bureau of WIPO, Published in: CH.
(Continued)

*Primary Examiner* — Mohamad Musleh
(74) *Attorney, Agent, or Firm* — Kaplan Breyer Schwarz & Ottesen, LLP

(57) ABSTRACT

An electromechanical relay is provided, comprising a magnetic system and a pivotable armature. A diagnostic switch is arranged on one side of the relay, and the set of contacts of the diagnostic switch is driven by the adjacent leg of the armature. A load switch is arranged on the bottom side of the relay and is driven by the second leg of the armature via an insulating coupling member.

15 Claims, 8 Drawing Sheets

(51) Int. Cl.

| | |
|---|---|
| ***H01H 50/14*** | (2006.01) |
| ***H01H 50/18*** | (2006.01) |
| *H01H 50/64* | (2006.01) |
| *H01H 51/22* | (2006.01) |

(52) U.S. Cl.
CPC ..... *H01H 50/541* (2013.01); *H01H 51/2236* (2013.01); *H01H 50/642* (2013.01); *H01H 51/229* (2013.01); *H01H 51/2272* (2013.01); *H01H 51/2281* (2013.01)

(56) References Cited

U.S. PATENT DOCUMENTS

| | | | |
|---|---|---|---|
| 4,855,699 | A | 8/1989 | Hoegh |
| 6,107,903 | A | 8/2000 | Sako et al. |
| 6,670,871 | B1 | 12/2003 | Saso et al. |

FOREIGN PATENT DOCUMENTS

| | | | | | |
|---|---|---|---|---|---|
| DE | 3600856 | A1 | | 7/1987 | |
| DE | 3837092 | A1 | | 5/1990 | |
| DE | 29502765 | U1 | | 5/1995 | |
| DE | 19705508 | C1 | | 8/1998 | |
| DE | WO 0007199 | A2 | * | 2/2000 | ..... H01H 1/403 |
| DE | WO 0007200 | A2 | * | 2/2000 | ..... H01H 1/403 |
| DE | 202004011488 | U1 | | 9/2004 | |
| EP | 0197391 | A2 | | 10/1986 | |
| GB | 838988 | A | * | 6/1960 | ..... H01H 50/16 |
| JP | 2002237244 | A | | 8/2002 | |
| WO | 9323863 | A1 | | 11/1993 | |
| WO | 9323866 | A1 | | 11/1993 | |

OTHER PUBLICATIONS

"Related International Patent Application No. PCT/EP2013/056570", "International Search Report and Written Opinion", Jul. 12, 2013, Publisher: PCT/ISA, Published in: EP.

* cited by examiner

RELAY HAVING TWO SWITCHES THAT CAN BE ACTUATED IN OPPOSITE DIRECTIONS

FIELD OF THE INVENTION

The invention relates to an electromagnetic relay comprising an electromagnetic system, an armature, a first switch, and a second switch.

BACKGROUND OF THE INVENTION

Prior art relays of this type (EP 0 197 391 A2; U.S. Pat. No. 4,703,293 A; U.S. Pat. No. 6,107,903 A) include an electromagnetic system having at least a coil, a coil core, and two pole pieces defining two opposing ends of the relay. The relay housing has fixed contacts of the switches at the opposing ends of the relay. The movable contacts of the switches are located at the end of contact springs which are connected via conductive spring elements in the central region of the relay to a respective active current connection. Two parallel contact springs are provided, with a total of four contacts for actuating four switches which are located on the upper side of the relay in corner positions.

From U.S. Pat. No. 6,670,871 B1 a polarized relay is known, which comprises a main body including an electromagnet and current supply paths for the latter and for fixed contacts of switches, and an armature that is pivotally mounted to the main body by means of two torsion springs and which has two leaf springs with movable contacts on the ends thereof.

A permanent magnet having a respective pole on its upper side and on its lower side is secured to the armature with its upper side and follows the movements thereof. Power supply to the movable contacts is accomplished via each of the torsion springs and the leaf springs, so that a separate use as a diagnostic switch on one side of the relay and as a load switch on the other side of the relay is not possible.

In a known safety switch relay (DE 36 00 856 A1) a base body is provided which encloses the excitation coil in form of a trough and forms a contact chamber on each of the two sides, each of which contains a main contact which are actuated by an armature which is formed on the end of a yoke as a one-armed lever and has an additional lever arm at the free end, which actuates an additional auxiliary contact. The main contacts and the auxiliary contact are arranged on the bottom side of the relay, together with terminal pins.

DE 197 05 508 C1 discloses an electromagnetic relay with a three-pole permanent magnet which is interposed between the pole pieces of the coil core and has a rotary coupling surface on which a two-leg armature of the relay is mounted. Each armature end actuates, via an associated slider, a respective switch on the bottom side of the relay, where additionally the terminal pins are located.

From DE 38 37 092 A1 an adjustable relay is known, comprising a coil and a one-armed armature that extends transversely to an actuation coil end and actuates an actuator of switch contacts, which actuator extends longitudinally of the coil, and which switch contacts are located in a row along the coil end opposite the actuation coil end, together with terminal pins.

WO 93/23866 A1 discloses a polarized power relay including a rocking armature on the upper side of the relay and a set of contacts with contact spring on the bottom side of the relay. A movable slider of an insulating material couples one of the armature ends to the movable end of the contact spring to open or close the set of contact springs depending on the armature position. A diagnostic switch that provides information about the position of the armature is not provided.

In a polarized miniature relay (DE 2 148 177 A) a base plate with terminal pins is provided, on which two movable load contact springs can be actuated between fixed load contacts transversely to the plane of the base plate. For this purpose, a rocking armature supporting actuator pins is pivotally mounted in parallel to the plane of the base plate and cooperates with pole plates which angularly encompass the ends of a permanent magnet. A coil with two windings and a core is disposed adjacent to the rocking armature between the pole plates. A foil with coil connections connects the windings with associated terminal pins on the bottom side of the base plate. Because of the close proximity of the load contacts and the load contact springs to the coil connections attached to the foil, the dielectric strength of the relay is assumed to be low.

SUMMARY OF THE INVENTION

The invention is based on the object to provide a relay requiring a smallest possible installation space and exhibiting high sensitivity, in which relay one switch is suitable as a diagnostic switch for the armature position and another switch is suitable as a load switch even for comparatively high amperage currents.

The electromagnetic relay comprises an electromagnetic system with a coil and a core aligned in a longitudinal direction and with ends that define a first and a second end of the relay. The pole pieces extend transversely thereto and support, on a first side of the relay, longitudinally extending magnetic poles cooperating with an armature of the relay, which has two armature legs. Close to the first end of the relay and on the first side of the relay, a first switch is arranged which can be used as a diagnostic switch. The first switch comprises at least one stationary fixed contact and a movable contact attached to an end of a contact spring which is secured to the first armature leg. The first switch is connected to power terminals which extend from a second side of the relay opposite the first side to the first side of the relay. A second switch usable as a load switch is arranged on the second side of the relay and comprises at least one stationary fixed contact and a movable contact attached to a contact spring. The movable contact is driven by the second leg of the armature via an electrically insulating coupling member. The power terminals of the second switch are arranged close to the first end of the relay on the second side of the relay, which is the bottom side of the relay facing away from the armature. So the two switches are arranged far from each other, at diagonally spaced apart locations on the relay. The first switch close to the armature is directly switched by the tilted position of the armature and is advantageously used as a diagnostic switch, since it enables to reliably detect the contact position of the antivalent load contact. The second switch which is arranged on the bottom side of the relay is used as a load switch, since there is sufficient space available at this position for accommodating adequately large contacts through which the load current is to flow, even with higher amperage.

With respect to the configuration of the relay, a rocking armature system is preferred. The contacts of the two switches are disposed on opposite ends of the coil with respect to the longitudinal extension thereof and move transversely to the longitudinal extension when the relay is switched. The first leg of the rocking armature is coordinated with the first switch, and the second leg of the rocking armature with the second switch, and this in such a manner that when the respective switch is moved downwards the switch is closed, and when moved upwards the switch is opened.

Therefore, the contact sets of the switches take antivalent switching states. The first switch near the armature is operated as a break contact switch, and the second switch used as a load switch is operated as a make contact switch. Further, the load switch which is driven through the coupling member is actuated by a spring attached to the armature and driving the coupling element. In this manner, the break contact function and make contact function of the load switch is improved.

The first switch that is operated as a diagnostic switch and break contact switch is favorably equipped with a double contact, to reliably signal its closed position.

The relay according to the invention may comprise a pole assembly and a coil assembly, which greatly simplifies the manufacturing of the relay. Specifically, the pole assembly may be produced with a magnetized permanent magnet before being combined with the coil assembly, thereby avoiding to damage the coil assembly in the magnetization process.

In a favorable design of the relay, the pole assembly and the fixed contacts of the switches are mounted in a support component. Preferably, the individual components of the pole assembly and the fixed contacts are embedded in plastic material within the support component.

In case of a configuration including a pole assembly and a coil assembly, the support component has a shelf-like configuration, so that the coil assembly may be inserted into the support component like a drawer.

The support component may have a power rail on its bottom side, which together with the contact spring of the load switch forms a current loop exerting an additional closing force on the load switch in case of a short circuit current.

A one-piece spring element may be mounted to the armature, which is effective as a contact spring of the switch at one end, and at the other end as an actuating spring (return spring) of the armature.

BRIEF DESCRIPTION OF THE DRAWINGS

Further details of the invention will become apparent from the exemplary embodiments which will be described below with reference to the drawings, in which.

DETAILED DESCRIPTION

Figure 1:
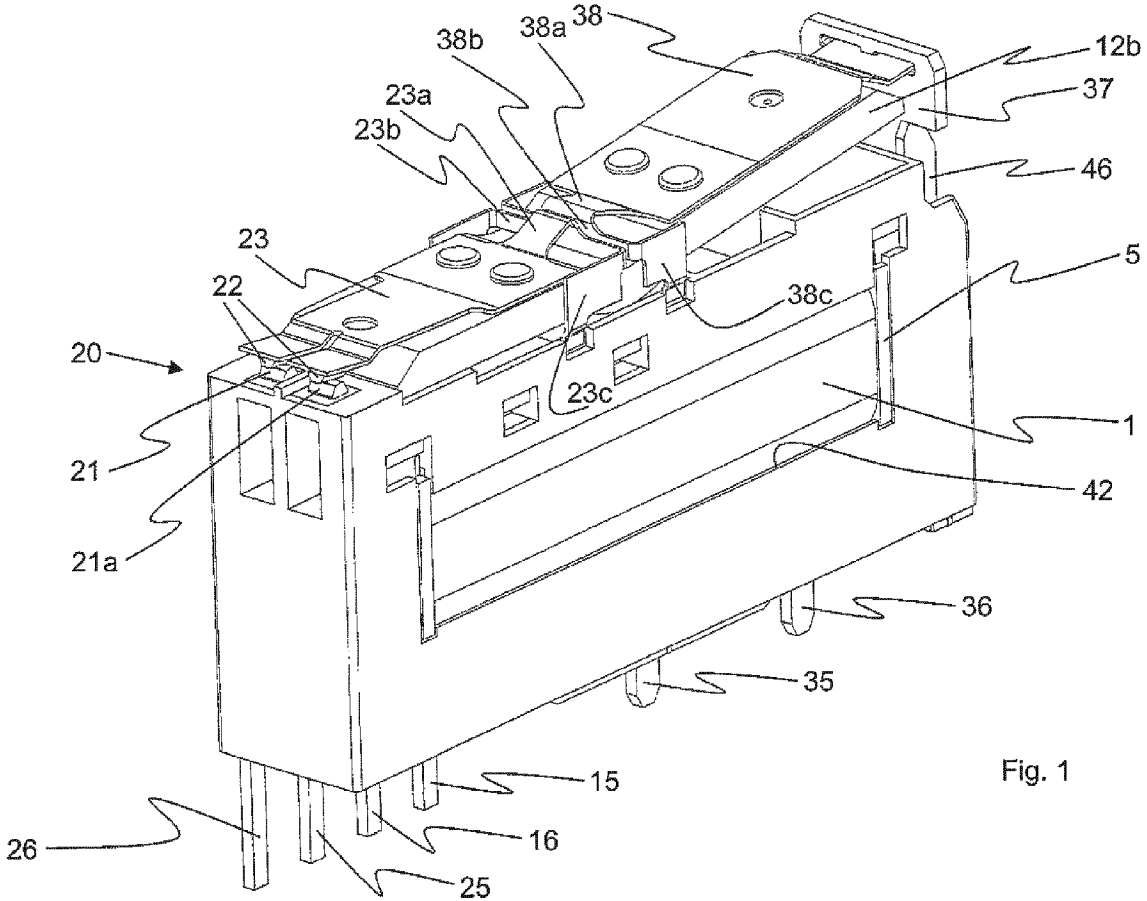
FIG. 1 is a perspective view of a first embodiment of the relay as seen obliquely from above to a longitudinal side and a short side, with the housing cap removed.

The electromagnetic relay comprises a magnetic system and a switch system (including a diagnostic switch 20 and a load switch 30), which are held together and protected by housing parts. The magnetic system comprises an electromagnet which is connected to a permanent magnet 11 and an armature 12 through magnetic flux pieces 7, 8, 9. The main part of the electromagnet is a coil assembly 10 consisting of a coil 1 wound around a support body 5, a ferromagnetic core 2, and ferromagnetic pole pieces 3 and 4 as a structural unit. The core 2 may be formed integrally with one of the pole pieces, or even integrally with both of the pole pieces. Magnetic flux pieces 7 and 8 define the poles of the electromagnet. Magnetic flux piece 9 forms a support piece for the armature 12 which is configured as a rocking armature here. In the first embodiment of the relay, permanent magnet 11 is configured with two poles and may be arranged at the end of the switch 20 as illustrated, or at the opposite end.

In the exemplary embodiment illustrated (FIG. 4), a connection block 6 is connected to the coil assembly 10, which is favorable in view of a compact configuration of the relay. Connection block 6 comprises switch signal terminal pins 15, 16 with bended legs 15*a*, 16*a* for direct connection to the winding ends of coil 1. A test contact terminal pin 25 is cranked and may thus be clamped between connection block 6 and pole piece 3.

Figure 3:
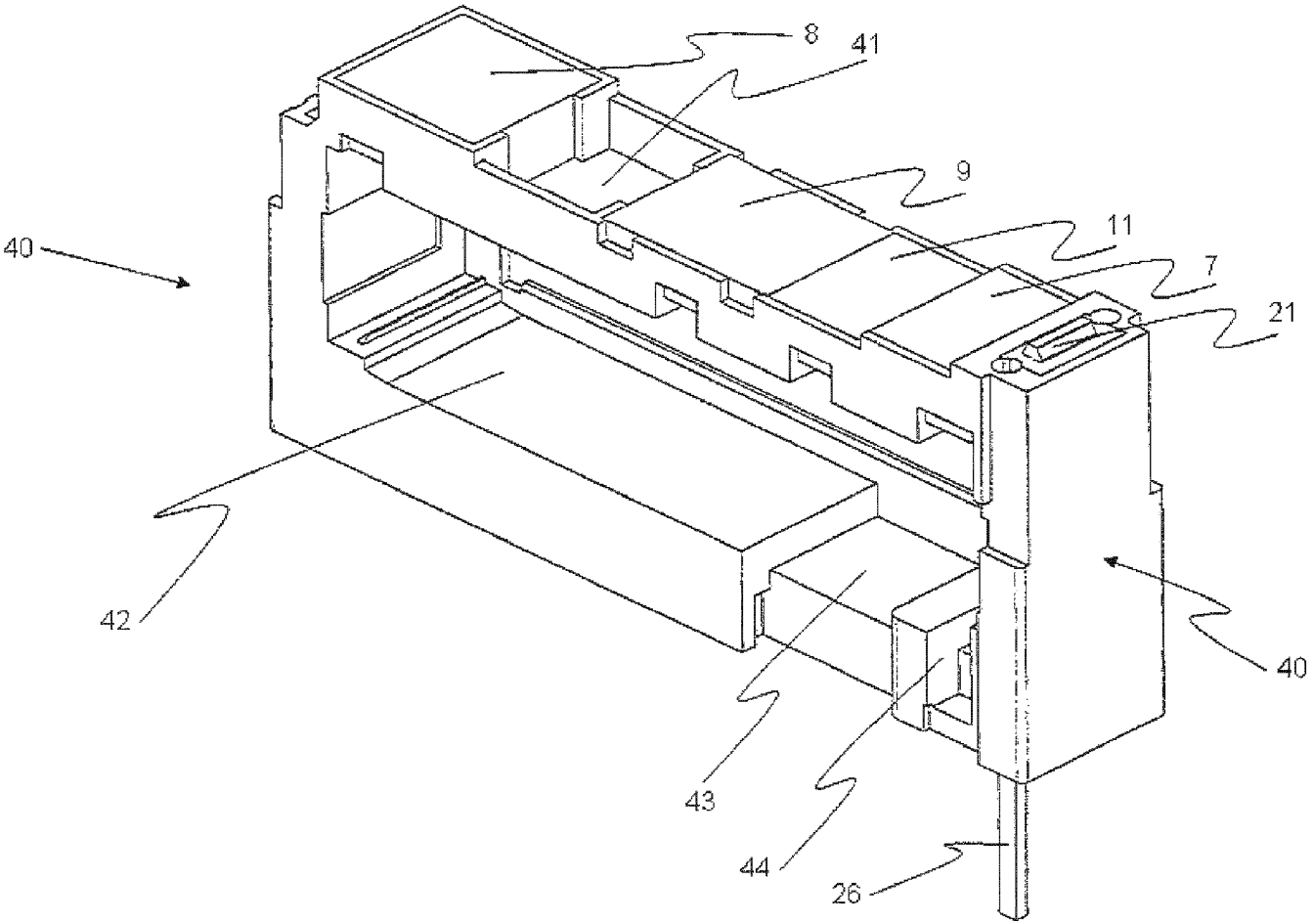
FIG. 3 is a perspective view of a support component as seen obliquely from above to a longitudinal side and a front end.
Figure 4:
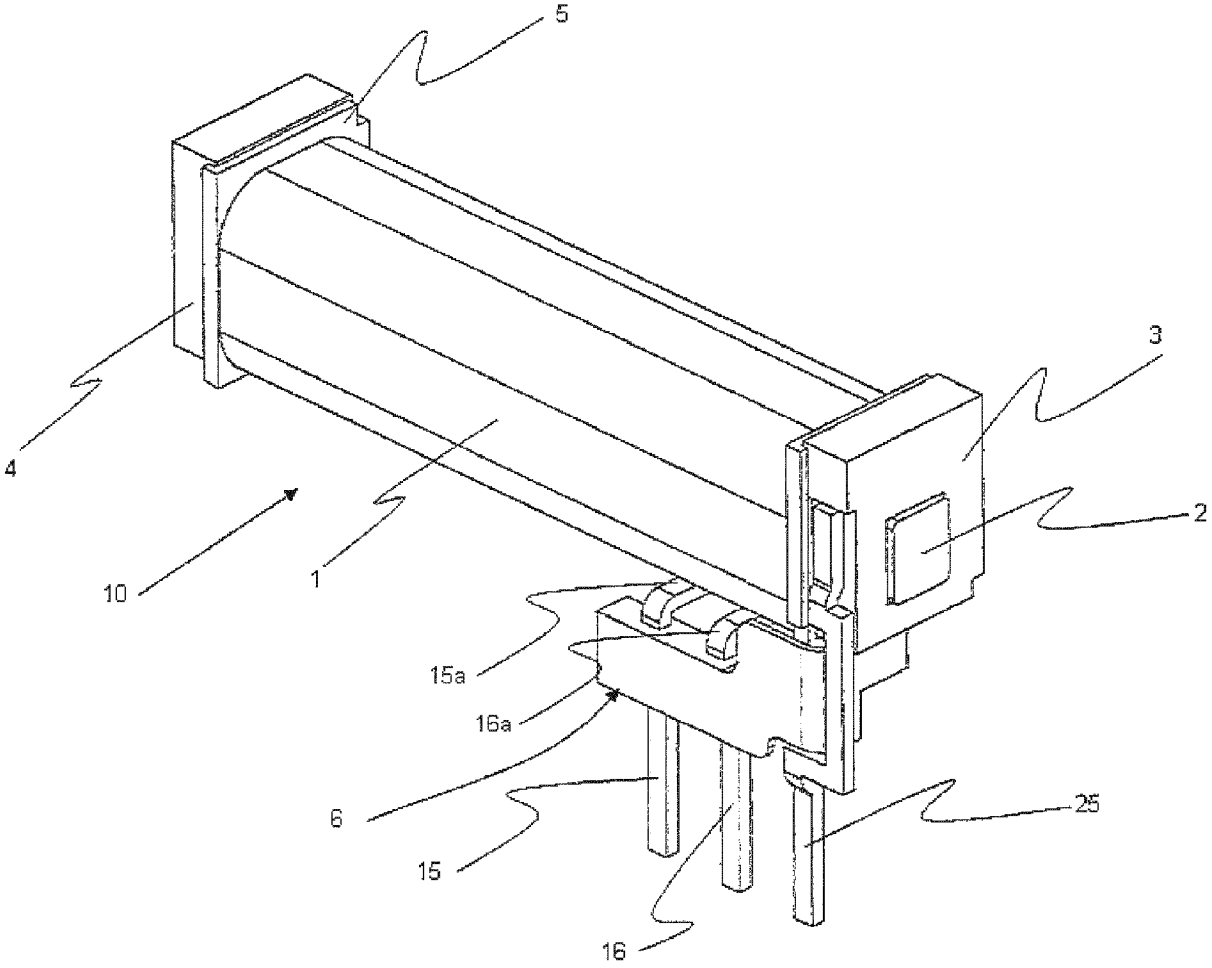
FIG. 4 is a perspective view of a coil assembly.

The component shown in FIG. 4 is adapted for being inserted into and secured in an intermediate shelf compartment or insertion cavity 42 of a shelf-like support component 40 (FIG. 3). For this purpose, insertion cavity 42 has two cavity extensions 43 and 44 for accommodating and positioning the connection block 6 adjacent to the coil assembly 10. The support component 40 of FIG. 3 further includes second test contact terminal pin 26 and an associated fixed contact 21. For the embodiment of the relay shown in FIGS. 1 and 5, however, it is intended that both test contact terminal pins 25, 26 are secured by being embedded in the support component 40.

Shelf-like support component 40 is further responsible for accommodating magnetic flux pieces 7, 8, 9 and permanent magnet 11. For this purpose, an upper shelf compartment or cavity 41 is provided, which is divided into pockets. Pieces 7, 8, 9, and 11 are fixed in the support component 40 by being embedding therein. Additionally, depending on the configuration according to FIGS. 3, 4 or FIGS. 1, 5, one fixed contact 21 or two fixed contacts 21, 21*a* are provided on the upper side of support component 40, which are electrically connected to terminal pins 25, 26 and which are fixed in the support component 40 by being embedding therein.

The switch system comprises a diagnostic switch 20 and at least one load switch 30, which are arranged on diagonally opposite positions to each other with respect to the relay. Diagnostic switch 20 comprises the fixed contact 21, optionally moreover the second fixed contact 21*a*, and a movable contact 22 which is attached to a contact spring 23. Contact spring 23 is secured to and actuated by the leg 12*a* of armature 12. Movable contact 22 establishes the electrical connection to terminal pin 25. In case two fixed contacts 21, 21*a* are used adjacent to each other, movable contact 22 bridges these two fixed contacts, so that a closed current path is formed through terminal pins 25, 26.

Load switch 30 includes a fixed contact 31 and a movable contact 32 which is located on a contact spring 33 that is mounted to support component 40 via a power rail 34 and is moreover electrically connected to a load terminal pin 35. Fixed contact 31 is conductively connected to a further load terminal pin 36. Contact spring 33 is actuated via an electrically insulating coupling member 37 whose upper end is mechanically connected to the second leg 12*b* of armature 12.

In addition to its two legs 12*a* and 12*b*, armature 12 further has a curved bearing portion 12*c* through which the armature rests on magnetic flux piece 9. Depending on the operational type of the relay (monostable, bistable) and the opening forces required at switches 20 and 30, the legs 12*a*, 12*b* of armature 12 have different lengths and are held by spring elements, with different pole gap widths. Such spring elements may be defined by portions of contact spring 23, an over-stroke spring 38, and contact spring 33. Contact spring 23 is riveted or otherwise secured to the leg 12*a* of armature 12 and has an armature spring projections, consisting of a spring web 23*a*, a torsion spring 23*b*, and a fastening tab 23*c*. Through fastening tab 23*c*, the armature 12 is secured to supporting piece 9 in a specific angular position relative to the surfaces of poles 7 and 8, e.g. welded thereto. A free end of over-stroke spring 38 is engaged in a slot of insulating coupling member 37 in order to establish the driving connection between leg 12*b* of the armature and the insulating coupling member 37 and hence switch 30. It is also possible for the insulating coupling member 37 to be pivotally secured directly to armature 12. In the exemplary embodiment illustrated, the over-stroke spring has an armature spring projection comprising a spring web 38*a*, a torsion spring 38*b*, and a mounting tab 38*c* which is welded or otherwise secured to supporting piece 9. The overall spring behavior of the relay is determined by the interaction of the spring forces of spring projections 23*a*, 23*b* and 38*a*, 38*b* with contact spring 33. Besides the spring forces, the magnetic attraction forces on armature 12 also determine whether a monostable or a bistable relay is obtained. The attraction forces on legs 12*a*, 12*b* of the armature are determined by the strength of permanent magnet 11 and the sizes of the pole faces of pole pieces 7, 8. When in one end position of the armature the magnetic attraction force is greater than the effective spring force in the lifting direction, and in the other end position the magnetic attraction force is smaller than the lifting force of the springs, we have a monostable relay. By contrast, when in both end positions of the armature the magnetic attractive force is greater than the effective spring force in the lifting direction, we have a bistable relay.

Contact spring 23 has a free end which is split like a fork to form two contact spring legs which have two contact pieces attached to their lower surfaces to form the contact 22. In this manner it is ensured, by spring force, that when closing switch 20 the movable contact 22 will come into contact with fixed contact(s) 21 and 21*a*. It will be appreciated that the spring force may also originate from the fixed contact, if the latter is configured resiliently (not illustrated).

If switch 20 has two adjacently arranged fixed contacts 21, 21*a* which are connected to terminal pins 25, 26 via the support component 40, then the contact spring 23 with its forked end will be effective as a bridging contact to switch the current flow between terminal pins 25, 26.

Support component 40 has a power rail 34 on its bottom side, in which the load terminal pin 25 is engaged. At the end of the relay facing away from the load switch, load contact spring 33 is riveted to the power rail 34 so as to extend along the power rail 34 and the bottom side of support component 40 until reaching the insulating coupling member 37 and to be linked to the lower end of the coupling member.

While support component 40 is the main component of the housing, additionally a housing bottom 50 and a housing cap 60 are provided. A shallow cavity 45 (FIG. 2) extends between the bottom side of support component 40 and housing bottom 50, which serves to accommodate the load contact spring 33 and its range of movement relative to fixed contact 31. Fixed contact 31 is riveted to load terminal pin 36 which in turn is secured to the housing bottom 50. Alternatively, fixation thereof on the support component 40 may be contemplated. Measures of attachment that may be employed include embedding in plastics, overmolding, adhesives, and clamping.

Figure 2:
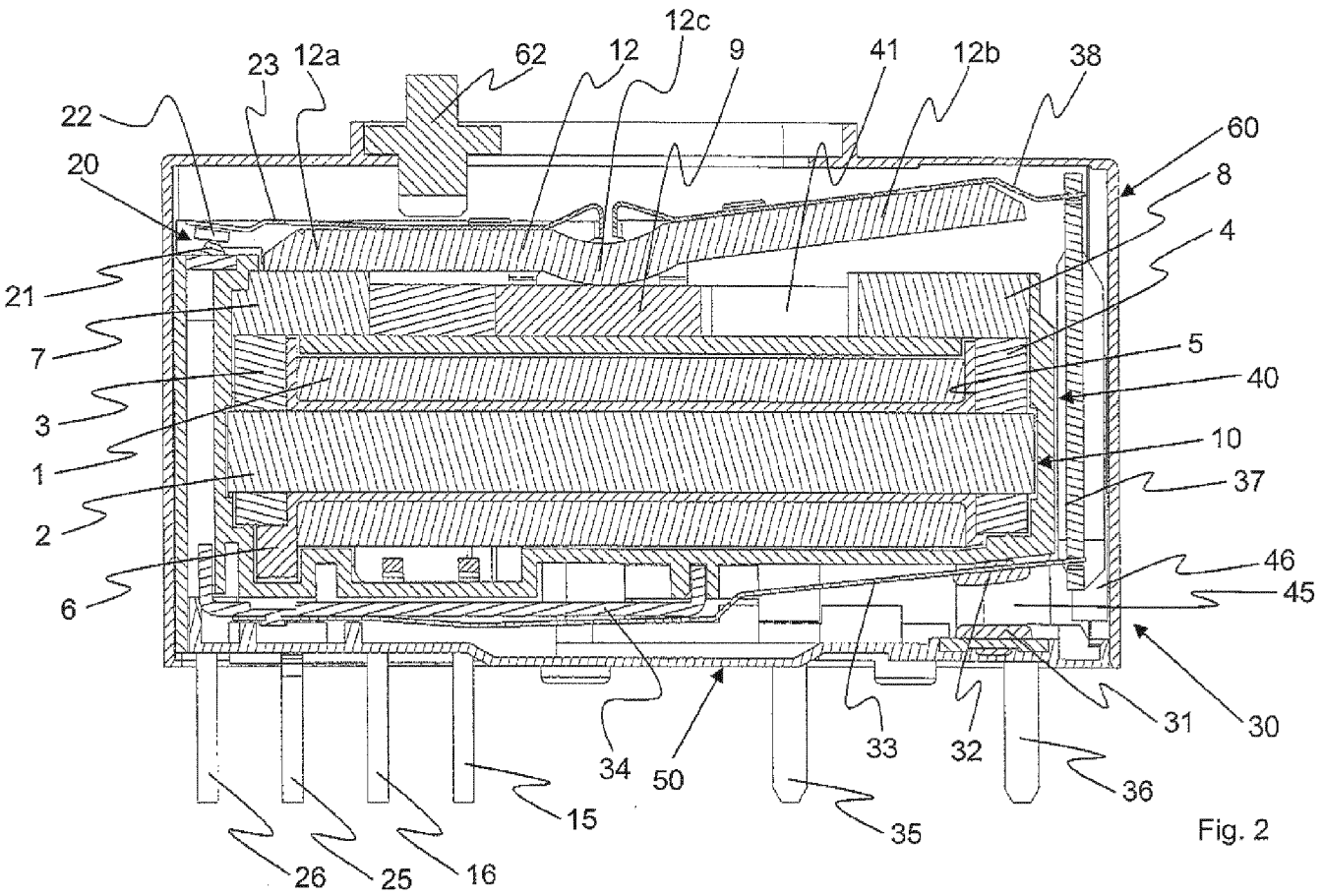
FIG. 2 is a longitudinal sectional view through the relay.
Figure 5:
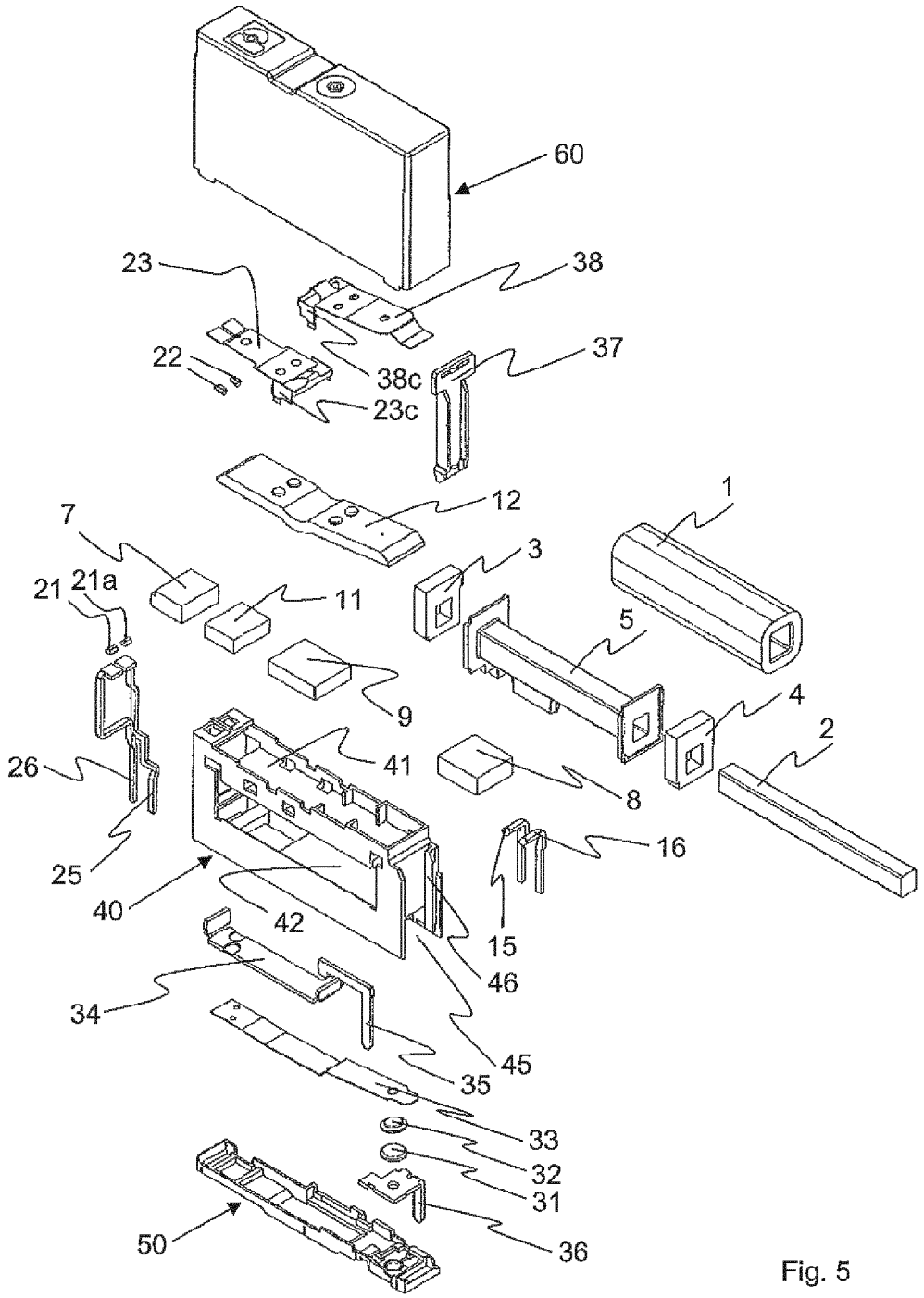
FIG. 5 is an exploded view of the individual components of the relay.

As shown in FIGS. 2 and 5, the support component has a guideway 46 for guiding the insulating coupling member 37. This guideway 46 and the entire assembled relay are covered by housing cap 60. A manually actuable slide switch 62 on the top of housing cap 60 permits to change the position of armature 12.

In case of a monostable configuration of the relay with the switch 20 as a diagnostic switch and break contact switch and the switch 30 as a load switch and make contact switch as illustrated in FIG. 2, the contact spring 23 with its spring projections 23*a*, 23*b* is responsible for the illustrated position of the armature. In a current-free state of the coil 1, load switch 30 is open. When a sufficiently strong drive current passes through coil 1, the electromagnet causes the armature 12 to switch, i.e. leg 12*b* is attracted by pole 8, and leg 12*a* is repelled from pole 7. Over-stroke spring 38 drives the insulating coupling member 37 which in turn drives the contact spring 33 with movable contact 32 which engages fixed contact 31 to close the load circuit via terminal pins 35, 36.

When coil 1 is de-energized, the spring forces on armature 12 take control to retract the armature 12 back into the rest position illustrated in FIG. 2. Should the movable contact 32 be fused to the fixed contact 31, the leg of the over-stroke spring 38 which is the right one in FIG. 2 will be tensioned until the movable contact 32 is torn away from fixed contact 31.

When load switch 30 is closed, a current path exists via terminal pin 35, power rail 34, contact spring 33 to movable contact 32 and fixed contact 31 and to terminal pin 36, with the current in power rail 34 and in contact spring 33 partially flowing in opposite directions. Thereby, electrodynamic forces are generated which increase the make contact force. This may be useful in the event of a short circuit, just as the fact that the load switch 33 is accommodated in the insulated cavity 45 below the support component 40 that accommodates the coil assembly 10.

Figure 6:
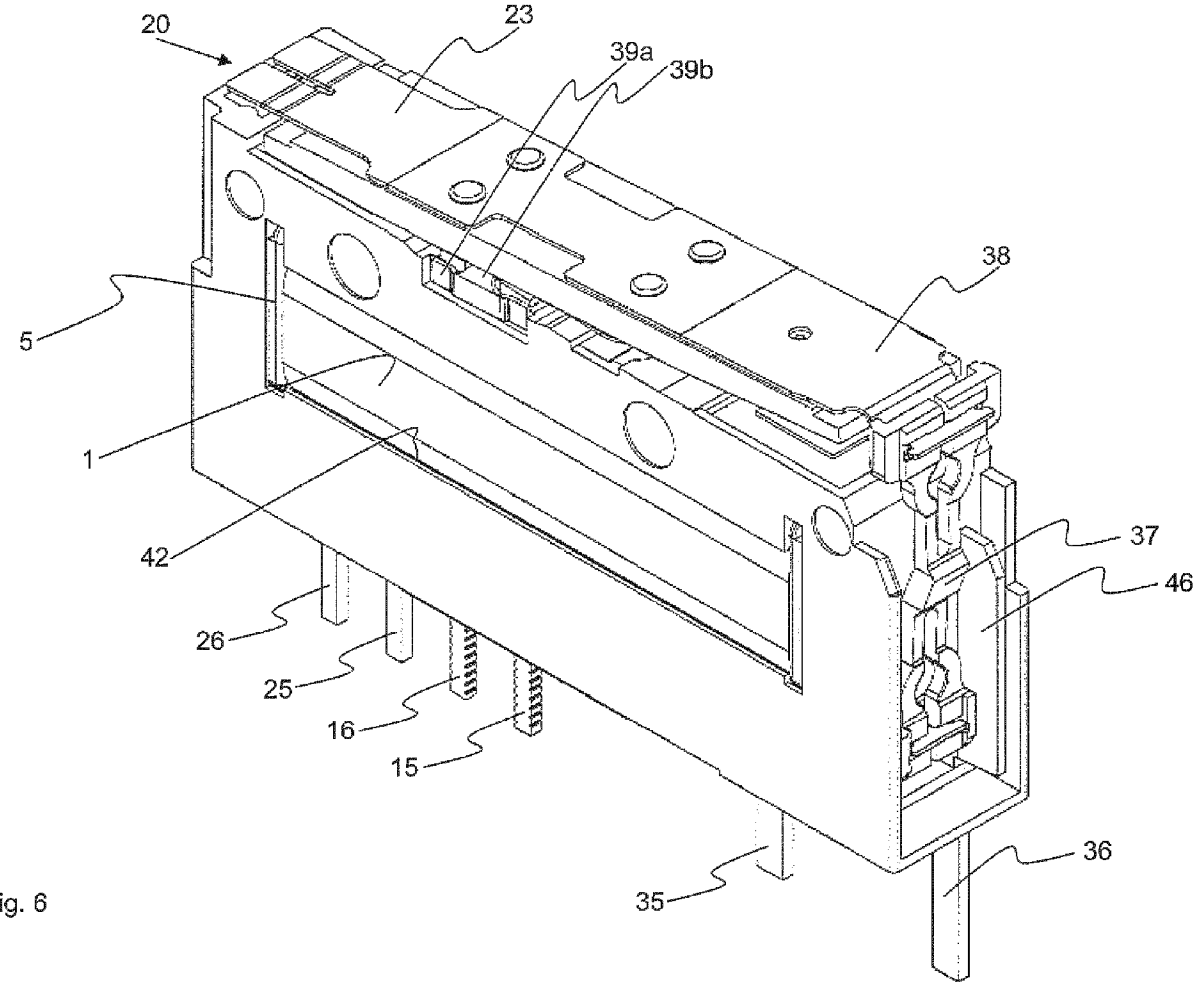
FIG. 6 is a perspective view of a second embodiment of the relay.
Figure 7:
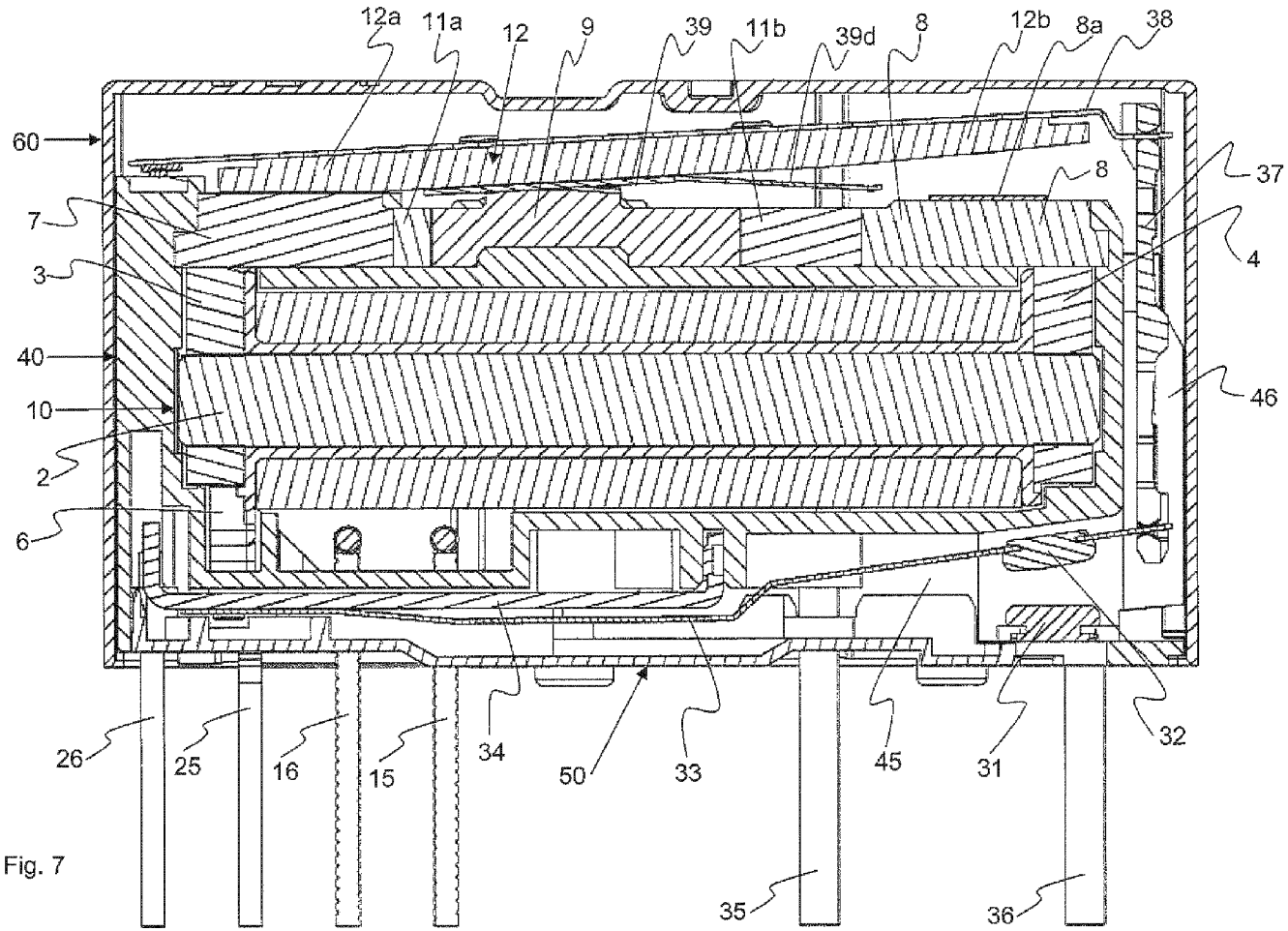
FIG. 7 is a longitudinal sectional view through the relay of FIG. 6.
Figure 8:
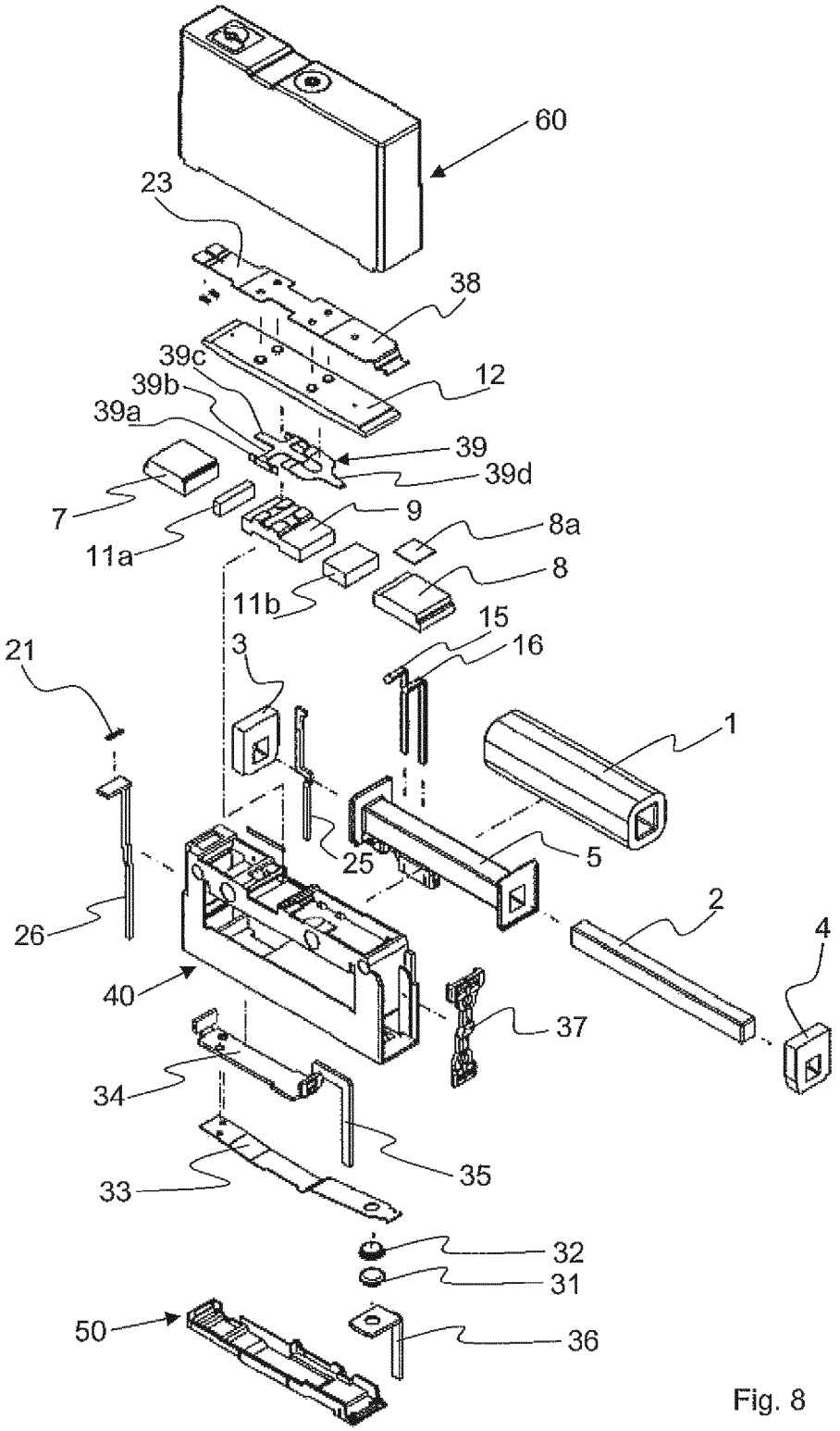
FIG. 8 is an exploded view of the relay.

FIGS. 6, 7, and 8 illustrate a second embodiment of the invention. Components similar to the first embodiment are designated with the same reference numerals. The general configuration of the relay according to the second embodiment is similar to that of the first embodiment, and therefore corresponding parts of the description will not be repeated and only the differences will be described in more detail.

In the second embodiment of the relay, permanent magnet 11 comprises two portions 11*a* and 11*b*, and interposed therebetween a magnetic flux piece 9 of soft iron so as to form a three-pole permanent magnet. Portion 11*a* has a higher coercive force when compared to portion 11*b*. The two portions 11*a* and 11*b* have the same polarity towards magnetic flux piece 9, that means either both are aligned with the south pole facing magnetic flux piece 9, or both with the north pole, while towards the outer ends of the relay, the permanent magnet 11 with a total of three poles presents only north poles, or only south poles, as the case may be. Magnetic flux piece 9 presents the adjacent polarity, i.e. south pole if the north pole of the permanent magnet faces outwards, and north pole if the south pole of the permanent magnet faces outwards.

In the second embodiment, the mounting of armature 12 is different from the first embodiment in that a cross-shaped spring 39 provides for the support of armature 12 on magnetic flux piece 9. Cross-shaped spring 39 has tabs 39*a* via which it is joined to magnetic flux piece 9 by welding, and further has a torsion web 39*b* and, transversely thereto, a support tab 39*c* for supporting armature 12.

Another tab 39*d* may extend from cross-shaped spring 39, which is adapted to dampen the impact of armature 12 on magnetic flux piece 8 and at the same time is tensioned thereby, which is useful upon a subsequent switching of the armature 12, since in this way the armature will more easily clear magnetic flux piece 8. Cross-shaped spring 39 is effective as a torsion spring, i.e. there will be no bearing friction and hysteresis loss of spring 39 is very small.

As another modification in the second embodiment, contact spring 23 and over-stroke spring 38 are formed integrally. Contact spring 23 is electrically conductive and is connected to electrically conductive armature 12 which in turn is connected, via electrically conductive cross-shaped spring 39, to electrically conductive magnetic flux piece 9 which in turn is in electrically conductive communication with test contact terminal pin 25.

For adjusting the adhesive force of leg 12*b* of armature 12 to magnetic flux piece 8, an intermediate piece 8*a* of sheet metal material or plastic is additionally provided. Namely, due to the different lengths of legs 12*a*, 12*b* of armature 12, the effective lifting forces thereon are different, which is somewhat compensated for by the interposition of piece 8*a*.

It will be apparent to those skilled in the art that the embodiments described above are intended as examples and that the invention is not limited thereto but may be varied in many ways without departing from the scope of the claims. Furthermore, the features also define individually significant components of the invention, irrespective of whether they are disclosed in the description, the claims, the figures, or otherwise, even if they are described together with other features.

What is claimed is:

1. An electromagnetic relay, comprising:

an electromagnetic system with a coil and a core aligned in a longitudinal direction and having ends that define a first and a second end of the relay at each of which pole pieces extend transversely thereto, which pole pieces are connected to a pole assembly that includes a permanent magnet and extends in parallel to the coil and the core along a first side of the relay that is opposite to a second side of the relay with respect to the coil and the core;

an armature arranged on the first side of the relay, which has two legs and is pivotally mounted relative to the pole assembly;

a first switch usable as a diagnostic switch, which is arranged on the first side of the relay close to the first end of the relay and comprises at least one fixed contact and one movable contact that is attached to a contact spring actuated by the armature and connected to test power terminals extending from the second side of the relay to the first side of the relay;

a second switch usable as a load switch, which is arranged on the second side of the relay close to the second end of the relay and comprises at least one fixed contact and one movable contact attached to a contact spring, which is actuated by the armature through an electrically insulating coupling member;

switch signal terminals which are arranged on the second side of the relay close to the first end of the relay and connected to the coil; and power terminals which are arranged on the second side of the relay close to the second end of the relay and connected to the second switch; and a housing for accommodating the electromagnetic system, the armature, and the switches.

2. The electromagnetic relay as claimed in claim 1, wherein the pole assembly includes a first and second magnetic flux piece arranged respectively adjacent to a respective pole piece and a third magnetic flux piece for pivotally supporting the armature, and wherein the permanent magnet is arranged between the first, second and third magnetic flux pieces.

3. The electromagnetic relay as claimed in claim 2, wherein the permanent magnet is formed unitarily and has two poles.

4. The electromagnetic relay as claimed in claim 2, wherein the permanent magnet is formed in two parts and has three poles.

5. The electromagnetic relay as claimed in claim 1, wherein the movable contacts are arranged in a manner so that when the first switch is open the second switch is closed, and vice versa.

6. The electromagnetic relay as claimed in claim 1, wherein the contact spring of the first switch on the first side of the relay extends in the longitudinal direction of the relay, with the movable contact near the first end of the relay; and wherein the contact spring of the second switch on the second side of the relay extends in the longitudinal direction of the relay, with the movable contact near the second end of the relay.

7. The electromagnetic relay as claimed in claim 1, wherein the armature extends in the longitudinal direction of the relay and is formed as a rocking armature, with the first leg thereof on the first side of the relay directly actuating the first switch, and the second leg thereof on the second side of the relay driving the insulating coupling member to actuate the second switch.

8. The electromagnetic relay as claimed in claim 1, wherein the electromagnetic system in cooperation with the armature and the force of springs is operable such that the first switch functions as a break contact switch and the second switch functions as a make contact switch.

9. The electromagnetic relay as claimed in claim 1, wherein the first switch has a movable contact with two contact pieces which are attached to a resilient fork-shaped end of the contact spring.

10. The electromagnetic relay as claimed in claim 1, wherein a coil assembly is provided as a structural unit including a coil wound around a support body, a ferromagnetic core, and ferromagnetic pole pieces.

11. The electromagnetic relay as claimed in claim 10, wherein the housing comprises a shelf-like support component which in an upper shelf compartment accommodates the pole assembly including the first, second and third magnetic flux pieces and a magnetized permanent magnet, and in an intermediate shelf compartment accommodates the coil assembly including the coil, the core, and the pole pieces.

12. The electromagnetic relay as claimed in claim 11, wherein the magnetized permanent magnet consists of two portions with a magnetic flux piece interposed therebetween and is effective as a three-pole magnet.

13. The electromagnetic relay as claimed in claim 1, wherein the armature is pivotally mounted on the pole assembly by means of a torsion spring.

14. The electromagnetic relay as claimed in claim 11, wherein the support component includes an electrically conductive power rail aligned in the longitudinal direction having one end near the first end of the relay, and wherein the contact spring of the second switch is secured to said end of the power rail to form a current loop, whereby in case of an elevated current an electrodynamic force is developing and applied on the contact spring in the closing direction of the second switch.

15. The electromagnetic relay as claimed in claim 1, wherein the housing comprises a housing cap including a manual switch for manually changing the position of the armature.

* * * * *